US008393463B1

(12) United States Patent
Graham

(10) Patent No.: US 8,393,463 B1
(45) Date of Patent: Mar. 12, 2013

(54) EYEGLASS CADDY

(76) Inventor: Gary Graham, Glacier, WA (US)

( * ) Notice: Subject to any disclaimer, the term of this patent is extended or adjusted under 35 U.S.C. 154(b) by 0 days.

(21) Appl. No.: 12/953,115

(22) Filed: Nov. 23, 2010

(51) Int. Cl.
*A45C 11/04* (2006.01)

(52) U.S. Cl. ..... 206/5; 206/37; 211/85.1

(58) Field of Classification Search ..... 206/5, 6, 206/38, 37; 211/85.1; 24/3.8; D3/265, 266; D9/712, 711
See application file for complete search history.

(56) References Cited

U.S. PATENT DOCUMENTS

| | | | | | |
|---|---|---|---|---|---|
| 177,415 | A | * | 5/1876 | Miser | 206/5 |
| 528,068 | A | * | 10/1894 | Begole | 206/5 |
| D31,530 | S | * | 9/1899 | Kulman | D9/712 |
| 636,811 | A | * | 11/1899 | Kirstein | 206/5 |
| 1,686,002 | A | * | 10/1928 | Herzon | 206/5 |
| D113,402 | S | * | 2/1939 | Schram | D3/266 |
| D154,472 | S | * | 7/1949 | Giuliana | D3/266 |
| D172,458 | S | * | 6/1954 | Baratelli | D3/265 |
| 2,809,766 | A | * | 10/1957 | Anderson | 220/326 |
| 3,994,391 | A | | 11/1976 | Holland | |
| 4,000,810 | A | | 1/1977 | Leblanc | |
| D298,835 | S | * | 12/1988 | Vukasinovich | D3/266 |
| D299,683 | S | * | 2/1989 | Marks | D3/265 |
| D333,561 | S | * | 3/1993 | Paulenco | D3/265 |
| D336,564 | S | * | 6/1993 | Kidd | D3/265 |
| D343,402 | S | * | 1/1994 | Scoppettone | D3/266 |
| 5,423,419 | A | | 6/1995 | Wentz et al. | |
| 5,526,924 | A | * | 6/1996 | Klutznick | 206/5 |
| 5,579,915 | A | * | 12/1996 | Liss | 206/554 |
| 5,590,760 | A | | 1/1997 | Astarb | |
| 5,626,224 | A | * | 5/1997 | Clark et al. | 206/5 |
| 5,687,837 | A | | 11/1997 | Seiler | |
| D398,224 | S | * | 9/1998 | Weder et al. | D9/712 |
| D405,608 | S | * | 2/1999 | Sumner, III | D3/266 |
| 5,878,873 | A | * | 3/1999 | Clark | 206/6 |
| D476,149 | S | * | 6/2003 | Andre et al. | D3/218 |
| D571,556 | S | * | 6/2008 | Raile | D3/265 |
| 2007/0215493 | A1 | * | 9/2007 | Servis | 206/5 |
| 2009/0122259 | A1 | * | 5/2009 | Szumski | 351/158 |

OTHER PUBLICATIONS

Homeliving, "Genuine Leather Eyeglass/Cell Phone Case," HomelivingStyle.com.

* cited by examiner

*Primary Examiner* — David Fidei
(74) *Attorney, Agent, or Firm* — Dwayne E. Rogge; Schacht Law Office, Inc.

(57) ABSTRACT

The eyeglass caddy or carrying device disclosed herein is designed as a rigid, substantially tubular apparatus which engages the frames of a pair of eyeglasses to house and protect the eyewear. The eyeglasses are held in place by frictional contact with the case and gravitational forces.

7 Claims, 5 Drawing Sheets

EYEGLASS CADDY

BACKGROUND OF THE DISCLOSURE

Field of the Disclosure

This disclosure relates to the field of rigid, portable devices for the carrying and protecting of eyewear, such as sunglasses, eyeglasses, eye shields and equivalents, as well as small electronic devices such as cameras, cell phones, sound devices and equivalents.

SUMMARY OF THE DISCLOSURE

Disclosed herein is a carrying device for small devices having a frame and a lens. The carrying device comprises a rigid rear portion, wherein the rear portion comprises a lanyard attachment portion. The device further comprises a rigid right side portion extending substantially orthogonal to the rear portion, wherein the right side portion is operatively configured to engage a frame portion of a pair of the small device, a rigid right front portion extending substantially orthogonal to the right side portion and substantially parallel to the rear portion, and a left side portion extending substantially orthogonal to the rear portion and substantially parallel to the right side portion. In one form, the left side portion is operatively configured to engage a frame portion of the small device. A left front portion is also disclosed, extending substantially orthogonal to the left side portion and substantially parallel to the rear portion. One portion of the apparatus may include a bottom retainer extending substantially orthogonal to the rear portion laterally positioned between the right side portion and the rear side portion. In general, the carrying device is operatively configured to engage the frame of the small device, and not contact the lens of the devices. The carrying device may be specifically configured to carry eyewear, such as eyeglasses, sunglasses, or equivalents.

In one form, the carrying device is arranged wherein the surfaces of the carrying device comprise a scratch-resistant material and are operatively configured to engage the eyeglasses or other small device.

The apparatus may be produced using a method comprising the steps of providing a substantially planar panel, heating the panel and folding it to form the particular components disclosed.

The method described above may also include the step of providing a scratch-resistant material on the surfaces of the carrying device, which is operatively configured to directly engage (contact) the small device.

DESCRIPTION OF THE PREFERRED EMBODIMENTS

While many prior art devices capable of carrying and/or protecting eyewear and small electronic devices are found on the market, a device that allows a user to protect such equipment quickly, readily insert and remove said equipment from said rigid case and avoid contacting the lens of the equipment has not been found.

Figure 1:
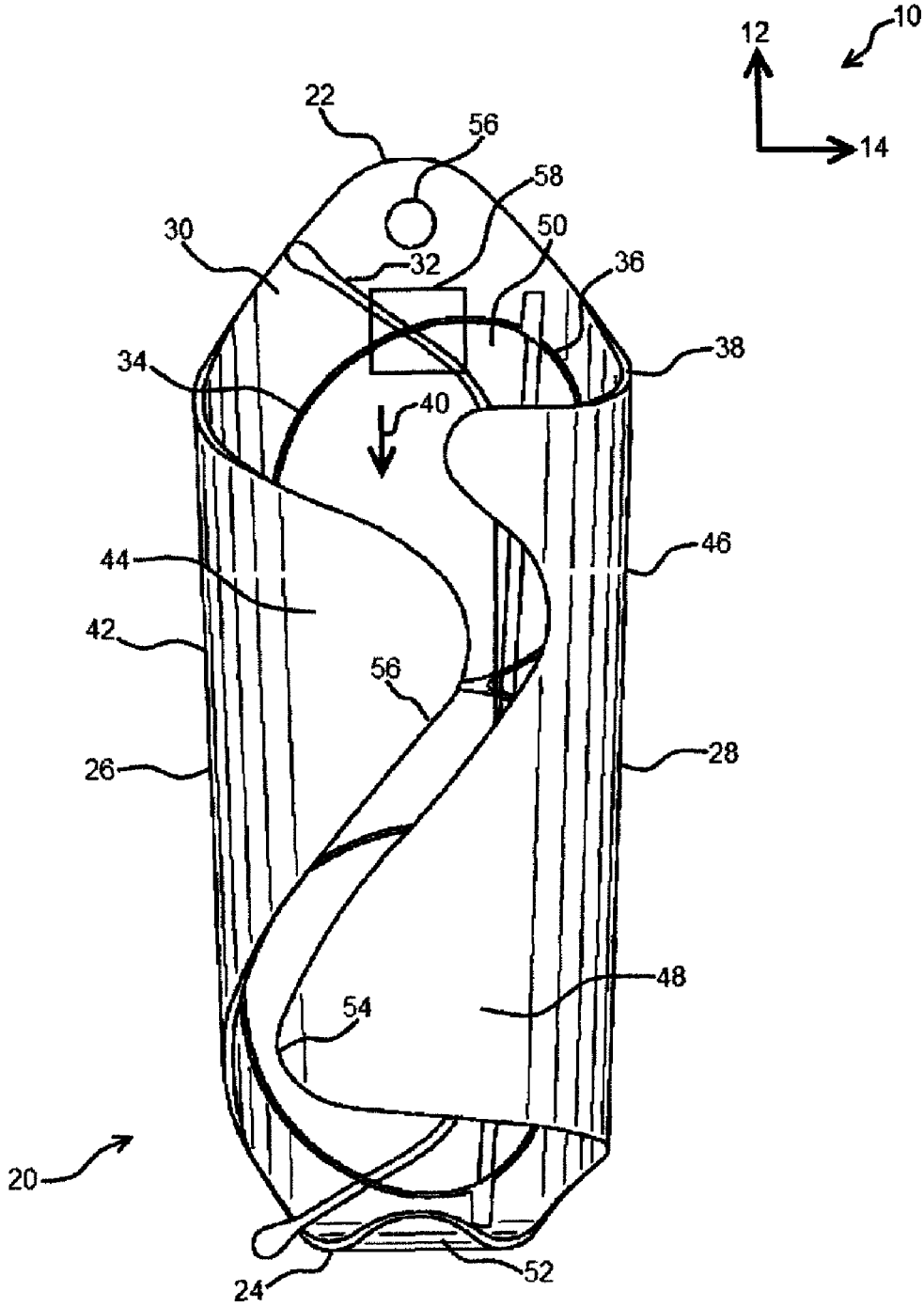
FIG. 1 is a front elevational view of one embodiment of the disclosure.

Looking to FIG. 1, one embodiment of the carrying device 20 is shown. Before beginning a detailed description, an axis system 10 is shown, comprising a vertical or longitudinal axis 12, a lateral axis 14, and in FIG. 2, a transverse axis 16. This axis system is intended to be descriptive of particular orientations and is not intended to be limiting. For ease of understanding, the description henceforth will describe a particular arrangement of the carrying device 20 used to carry eyewear 36, although one of ordinary skill in the art will be able to understand that the same device can be used to carry other devices having a frame (body) and a lens which may take the form of an electronic display screen often found on the front of mobile phones, or on the back of small point and shoot style cameras.

Figure 6:
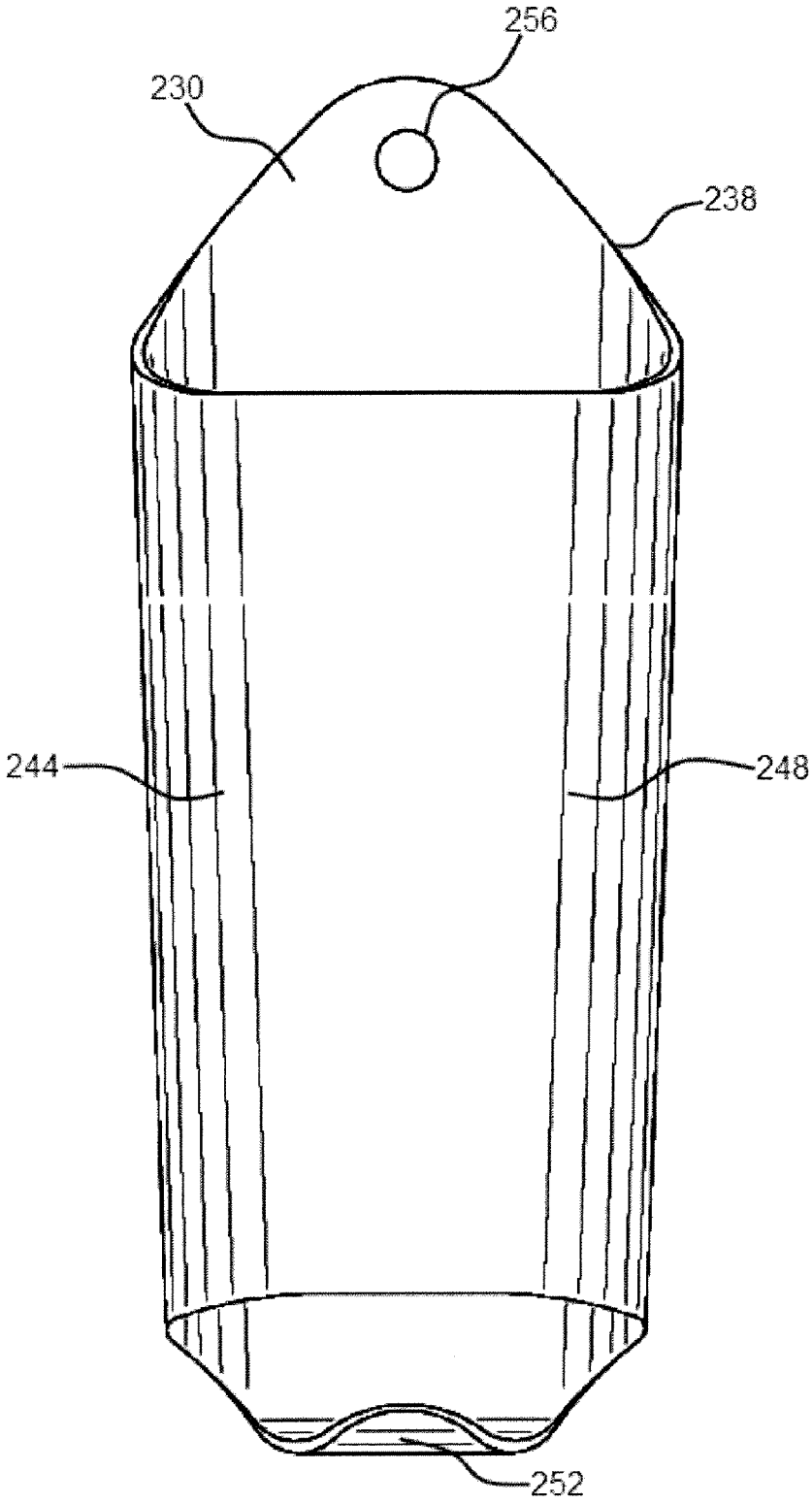
FIG. 6 is a front elevational view of a third embodiment of the disclosure.

The carrying device 20 is generally comprised of a single piece of material, such as a flat panel of plastic, although a tubular embodiment, as shown in FIG. 6, could be extruded, cast, or molded. Returning to FIG. 1, the carrying device 20 is defined by a top 22 and a bottom 24, which is vertically opposite the top 22. Additionally, a right side 26 and left side 28 are defined for ease of description and are not intended as limiting orientations. The carrying device 20 comprises a rear portion 30, which in operation would generally engage the earpiece portion 32 of the frame 34 of the eyewear 36. As can be seen, the upper edge 38 of the carrying device 20 is open to allow vertical insertion of the eyewear 6 in direction 40. Removal of the eyewear 36 is accomplished in the opposing direction. The carrying device 20 also comprises a right fold or bend 42 connecting the rear portion 30 to a right front portion 44. Similarly, a left fold or bend 46 connects the rear portion 30 to a left front portion 48. In one form, the enclosure defined by the rear portion 30, right front portion 44, and left front portion 48 tapers from a widest portion near the top 22 to a narrower portion near the bottom 24 so as to frictionally engage the eyewear 36 when inserted. Of particular interest, when inserted, the eyewear 36 contacts the carrying device 20 at the frame portion 34, such that the lens portions 50 will not come in contact with any portion of the carrying device 20.

Figure 2:
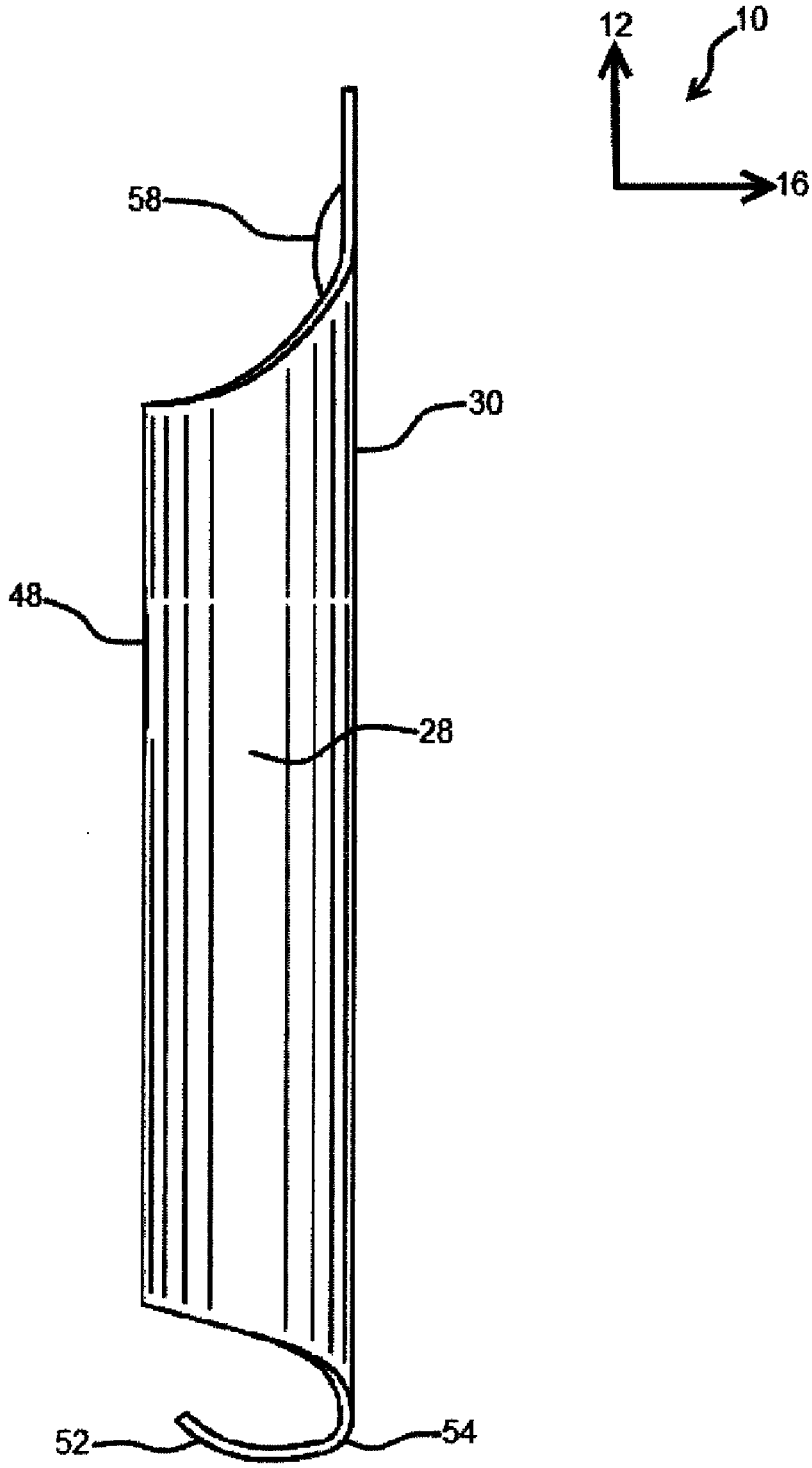
FIG. 2 is a side elevational view of the embodiment shown in FIG. 1.
Figure 3:
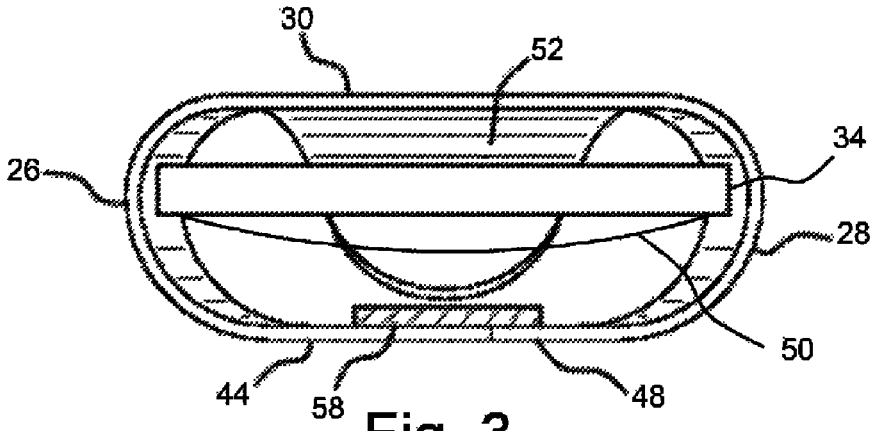
FIG. 3 is a top plan view of the embodiment shown in FIG. 1.
Figure 4:
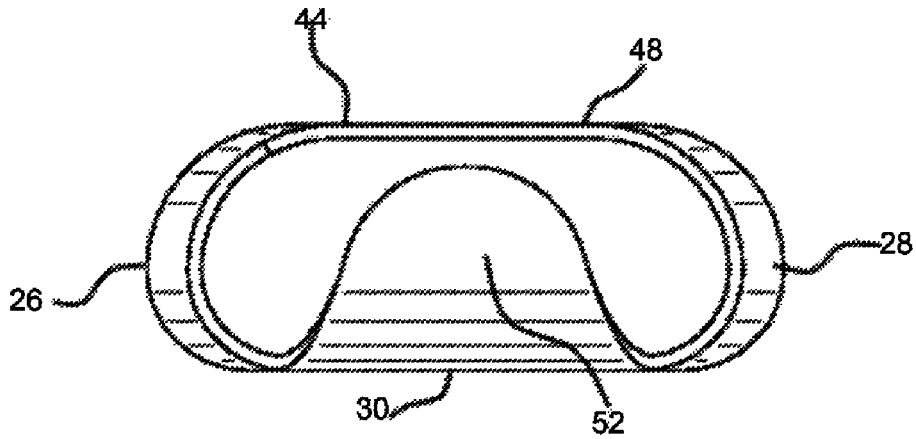
FIG. 4 is a bottom plan view of the embodiment shown in FIG. 1.

To further maintain the eyewear 36 within the carrying device 20, a bottom retainer 52 is disclosed, which may be formed initially as a portion of the rear portion 30 and then bent along the fold or bend 54, as shown in FIG. 2. Furthermore, a gap may be provided between the bottom retainer 52 and all surfaces of both of the left side portion 28 and the right side portion 26 such that each of the left side portion 28, right side portion 26, and the bottom retainer 52 are separately attached to the rigid rear portion as clearly shown in FIGS. 1 and 2.

In the embodiments shown in FIGS. 1-4, the left side 28 comprises an inward edge 54 that is substantially parallel to an inward edge 56 of the right side 26 with a gap there between. This embodiment provides excellent protection of the eyewear 36 and a visually pleasing design.

Figure 5:
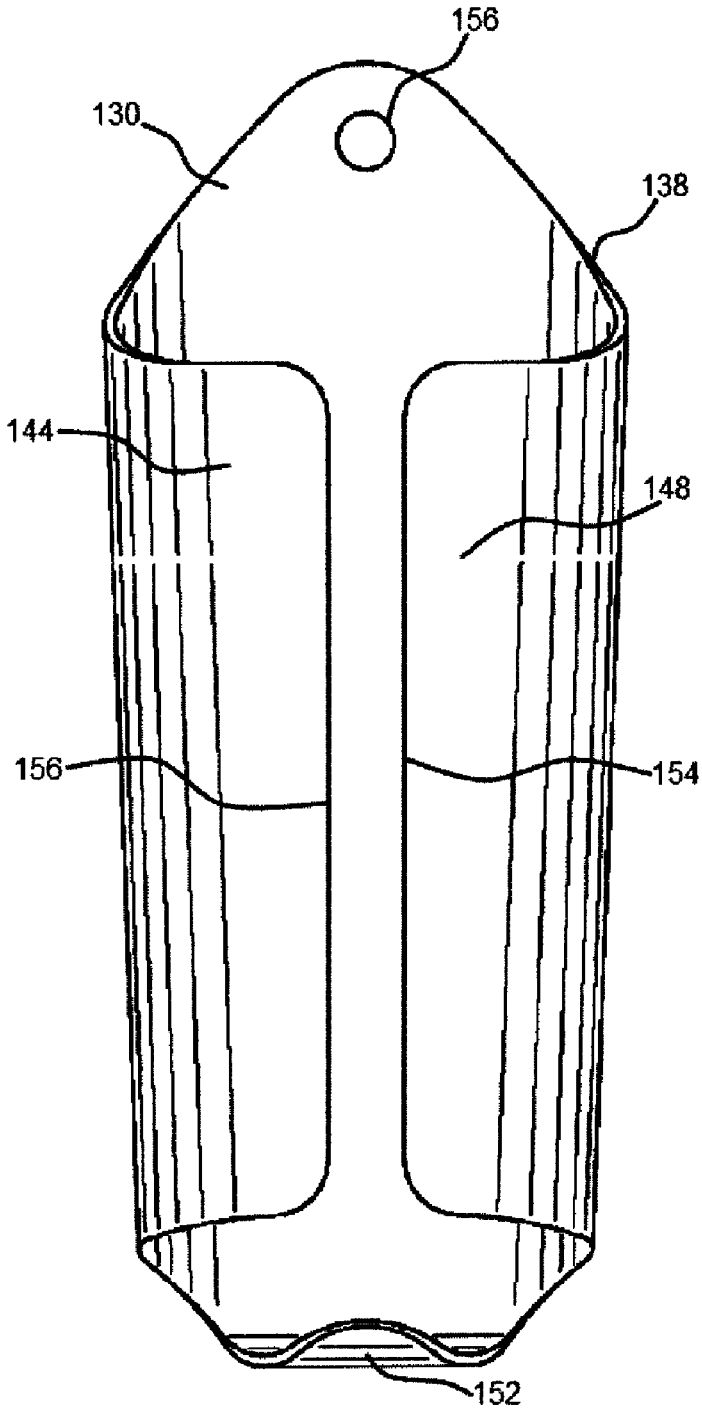
FIG. 5 is a front elevational view of a second embodiment of the disclosure.

Looking to FIG. 5, another embodiment is shown wherein similar components utilize the same numbering system with a 1 prefix. For example, the rear portion of FIG. 1 is designated 30 whereas the rear portion of FIG. 5 is designated 130. Thus, it can be seen how the edge 156 of the right front portion 144 is substantially linear and substantially parallel to the edge 154 of the left front portion 148. This embodiment operates in the same way with a unique edge design.

Looking to FIG. 6, another embodiment is shown wherein similar components utilize the same numbering system as previously utilized with a 2 prefix. In this embodiment, the rear portion 230, right front portion 244, and left front portion 248 are seamless in that the previously described edges 54 and 56 are not present. Obviously, this embodiment would not normally be made of a flat portion of material bent into the shapes previously described in reference to FIGS. 1-5; instead, this embodiment may be extruded or otherwise produced from a tubular portion of material.

In use, the carrying device 20 may be carried in a user's pockets, such as a shirt pocket, or may be affixed to a user's clothing. Additionally, a lanyard attachment portion or eyelet 56 may be utilized, which may attach to a piece of string, rope, or other lanyard that would generally be affixed around a user's neck for easy carrying of the apparatus. In this way, the edge 38 would always be in a vertically uppermost position, such that the eyewear 36 would not fall out as may tend to happen if the carrying device 20 were inverted while the eyewear 36 was placed therein. Additionally, as the interior portion of the carrying device 20 may be tapered as previously described, there may be a slight frictional engagement to further maintain the eyewear 36 in place within the carrying device 20. In other forms, a pocket clip, magnet pair, or a similar connecting device could be utilized to attach the carrying device 20 to a user's clothing, pocket, belt or equivalent.

In one form, a deformable cushion portion 58 may be utilized to further retain the eyewear 36 within the carrying device 20. This cushion 58 may be comprised of a small volume of foam rubber or similar material which would deform inward as the eyewear is pressed past it, and reform back to its extended shape to from a barrier to accidental removal of the eyewear 36 from the carrying device 20.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

Therefore I claim:

1. A carrying device for carrying of small devices having a frame and a lens, the carrying device comprising:

a. a rigid rear portion;

b. a rigid right side portion extending substantially orthogonal to the rear portion;

c. wherein the right side portion is configured to contact the frame of the small device and does not contact the lens of the small device;

d. a rigid right front portion extending substantially orthogonal to the right side portion and substantially parallel to the rear portion;

e. a left side portion extending substantially orthogonal to the rear portion and substantially parallel to the right side portion;

f. wherein the left side portion is configured to contact the frame of the small device and does not contact the lens of the small device;

g. wherein the right side portion and the left side portion laterally taper towards each other from a wider lateral distance at an upper region to a narrower distance at a lower portion, thus providing a friction fit to the frame portion of the small device when inserted;

h. wherein the carrying device is substantially larger in a longitudinal direction as measured from a the upper region to the lower region than in a lateral direction measured from an outermost limit of the right side portion to an outermost limit of the left side portion;

i. a left front portion extending substantially orthogonal to the left side portion and substantially parallel to the rear portion;

j. a bottom retainer extending substantially orthogonal to the rear portion laterally positioned between the right side portion and the rear side portion; and k. wherein the carrying device engages the frame of the small device, and does not contact the lens of the device.

2. The carrying device as recited in claim 1 wherein the surfaces of the carrying device operatively configured to engage the small device comprises a scratch-resistant material disposed upon inner surfaces of the carrying device.

3. The carrying device as recited in claim 1 wherein the rear portion, left side portion, left front portion, right side portion, right front portion, and bottom retainer are formed of a unitary structure.

4. The carrying device as recited in claim 1 wherein the relative size and positioning of the right side portion to the left side portion are configured to carry eyewear.

5. The carrying device as recited in claim 1 wherein the right side portion and left side portion comprise facing edges with a gap therebetween such that the right side portion and left side portion do not contact at the front portions thereof.

6. The carrying device as recited in claim 1 wherein the rear portion comprises a surface defining a void there through forming a lanyard attachment portion for attachment of a lanyard to be suspended around a user's neck.

7. The carrying device as recited in claim 1 further comprising a gap between the bottom retainer and all surfaces of both of the left side portion and the right side portion such that each of the left side portion, right side portion, and the bottom retainer are separately attached to the rigid rear portion.

* * * * *